US006048491A

United States Patent [19]

Norström et al.

[11] Patent Number: 6,048,491

[45] Date of Patent: Apr. 11, 2000

[54] STEEL ALLOY, STEEL PRODUCT AND USE THEREOF

[75] Inventors: Lars-Åke Norström; Henrik Jesperson, both of Hagfors, Sweden

[73] Assignee: Uddeholm Tooling Aktiebolag, Hagfors, Sweden

[21] Appl. No.: 09/194,431

[22] PCT Filed: Jun. 23, 1997

[86] PCT No.: PCT/SE97/01110

§ 371 Date: Nov. 30, 1998

§ 102(e) Date: Nov. 30, 1998

[87] PCT Pub. No.: WO97/49839

PCT Pub. Date: Dec. 31, 1997

[30] Foreign Application Priority Data

Jun. 26, 1996 [SE] Sweden ..... 9602518

[51] Int. Cl.[7] ..... C22C 38/44

[52] U.S. Cl. ..... 420/108; 420/113; 148/333; 148/335

[58] Field of Search ..... 420/108, 113; 148/335, 333

[56] References Cited

U.S. PATENT DOCUMENTS 4,428,781 1/1984 Norström ..... 148/36

FOREIGN PATENT DOCUMENTS 6-346185 12/1994 Japan .

*Primary Examiner*—Deborah Yee

*Attorney, Agent, or Firm*—Arent, Fox, Kintner, Plotkin & Kahn

[57] ABSTRACT

A steel alloy ahs the following composition in weight % 0.075–0.15% C from traces to max. 1.0 Si, 1–3 Mn, 2–5 Cr, 1–4 Ni, wherein the total amount of Mn+Cr+Ni>6, 0.1–1.0 Mo, which wholly or partly can be replaced by the double amount of W, max. 0.015 P, max 0.02 S, balance essentially only iron and impurities and accessory elements in normal amounts.

15 Claims, 3 Drawing Sheets

0.1 mm

STEEL ALLOY, STEEL PRODUCT AND USE THEREOF

TECHNICAL FIELD

The invention relates to a steel alloy having a certain chemical composition, a steel product made of the steel alloy, and use of the steel product. The invention particularly relates to the use of the steel product for the manufacturing of plastic moulding tools.

BACKGROUND OF THE INVENTION

A number of demands, which are difficult to combine, are raised on materials for the manufacturing of plastic forming tools. Among these demands, in the first place the following ones should be mentioned:

- A high and even hardness and accompanying strength, regardless the physical dimensions of the product, a feature which is particular important because the mould cavity usually has to be engraved out of the core of the piece of steel.
- A very high hardenability, i.e. through hardened ability also in very large dimensions.
- Very homogenous features throughout the whole piece of steel.
- A high toughness at room temperature but also at lower temperatures, since plastic moulds often are provided with cooling channels in order to cool the tool between the shots in order to increase the production capacity.
- A good mechanical machinability and also a good electrical discharge machinability (EDM).
- A good weldability
- A good surface hardenability, including a good case-hardenability and surface nitridability, such as ability to be surface hardened through ion nitriding.

It is also desired to simplify the heat treatment and, if possible, to completely eliminate hardening and tempering which substantially influence the total production costs and which also can cause cracks or other defects in the material.

The material which so far has been regarded to be the material which has satisfied the above requirements best is the material which since decades is known under its tradename IMPAX® SUPREME and which has the following nominal composition: 0.37C, 0.3 Si, 1.4 Mn, 2.0 Cr, 1.0 Ni, 0.2 Mo, 0.008 S, balance iron and unavoidable impurities and accessory elements. This material is tough hardened to 290–330 HB in its delivery condition. Successively, however, demands have been established upon plastic moulding tools having better performance than what IMPAX® SUPREME can offer. Above all a better hardenability, a higher and more even hardness independent on dimensions, a better weldabilty and electrical discharge machinabilty, and a better toughness are desired.

It has also been suggested in the past that a steel having the nominal composition 0.05 C, 0.3 Si, 2.0 Mn, 3.0 Cr, 1.5 Ni, 0.3 Mo, balance iron and unavoidable impurities, intended i.a. for tubes and for chains, particularly for anchor chains, should be useful also for plastic moulding tools. This steel, however, has not been able to satisfy the above specification of features and has, as far as is known to the applicant, never been used as a plastic moulding steel.

BRIEF DESCRIPTION OF THE INVENTION

The object of the invention is to provide a steel alloy and a steel product which satisfy the above mentioned combination of features. The invention also aims at providing a material which can be manufactured in a more rational mode than the above mentioned IMPAX® SUPREME as well as other conventional plastic moulding tool steels. Particularly, the invention aims at providing a steel which need not be hardened and tempered but can be used with the structure which the steel obtains after cooling after finished hot working through forging and/or rolling to the shape of blocks, rods, or plates. These and other objectives can be achieved therein that the steel has the composition which is stated in the appending claims, wherein the steel after finished hot working and cooling to room temperature obtains a homogenous structure through the whole piece of steel independent of its physical dimensions, said structure consisting of a so called low carbon lath martensite having a hardness which typically lies in the range 350–380 HB.

In the following, the importance of the individual elements and their interaction with each other shall be explained. All percentages relating to the chemical composition of the steel refer to weight-% unless something else is stated.

Carbon shall exist in the steel in an amount of at least 0.075%, preferably at least 0.08%, and suitably at least 0.09% in order that the steel shall achieve a desired hardness and strength. The C content must not exceed 0.15%. If the C content is higher, the steel will be too hard and brittle and difficult to work after cooling from the hot working temperature to room temperature. The alternative would be to temper the steel, but that would cause an extra cost which is not desired and is contrary to the desire to be able to use the steel for the manufacturing of plastic moulding tools without any foregoing heat treatment Preferably, the steel should not contain more than 0.12% C. A nominal C content of the steel 0.10%.

Silicon is not an essential element in the steel according to the invention but is normally present as a residue from the desoxidation of the steel melt. The steel, however, should not contain more than 1.0% Si. Normally, the steel contains from traces up to max. 1.0% Si.

Manganese, chromium and nickel are elements which contribute to affording a good hardenably to the steel and shall exist in a total amount of at least 6%.

Manganese shall exist in an amount of at least 1%. If the Mn content is lower, the steel will get a too low hardenabiity, which can not be completely compensated by higher contents of nickel and/or chromium. The steel however, must not contain more than 3% Mn. If the Mn content is higher, there is risk for temper brittleness and hence a risk for grain boundary fractures when the steel is used for plastic moulding tools.

Chromium shall exist in the steel in an amount of at least 2%. If the Cr content is lower, the steel will get a too low hardenability, which can not completely be compensated by higher amounts of manganese and/or nickel. The steel, however, must not contain more than 5% Cr, preferably max. 4% Cr. If the content is higher, there is risk that the steel after cooling will contain a significant content of ferrite in the structure, which according to the invention shall consist of a low carbon lath martensite. An optimal Cr content is 3%.

Nickel also contributes to the hardenability of the steel but in the first place to a desired toughness. The steel therefore shall contain at least 1% Ni, preferably at least 1.5% Ni. The lower Ni content can be tolerated at extremely low contents of phosphorus, while the upper Ni content is set in a first place by cost reasons. The steel therefor shall contain max. 4% Ni, preferably max. 3% Ni. An optimal content is 2% Ni.

Molybdenum is an element which favours the toughness of the steel, particularly in the case of slow cooling, and shall therefor exist in an amount of at least 0.1%, preferably at least 0.2%. Higher amounts of molybdenum, will, in a degree more than chromium, cause a risk to formation of ferrite, wherefore the Mo content is maximised to 1%, suitably to max. 0.5%, or still more conveniently max. 0.4%. An optional Mo content is 0.3%.

Phosphorus is an element which can cause embrittlement. Its damaging effect to some degree can be compensated for by nickel and/or molybdenum. Phosphorus, however, must not exist in contents higher than 0.015%. Preferably, the P content is max. 0.012%, suitably max. 0.010%.

Sulphur also is an embrittling element and must therefore not exist in contents exceeding 0.02%. Sulphur, however, improves the machinability and may therefore exist in a certain amount as an element which from that point of view is favourable. In order to achieve an adequate improvement of the machinability of the steel, the sulphur content should be at least 0.005%. An optimal S content is 0.005–0.010%.

Tungsten is an element which normally should not exist in the steel, because it is expensive and also because it would complicate scrap recycling. In principle, however, tungsten, can be tolerated as a substitute for molybdenum, the double amount of tungsten completely or partly replacing molybdenum.

Aluminium may exist at an impurity level as a residue from the desoxidation treatment of the molten metal.

Strong carbide formers, such as vanadium, niobium, tantalum, titanum, zirconium shall not exist in the steel in amounts exceeding impurity levels.

BRIEF DESCRIPTION OF DRAWINGS

In the following, the invention will be explained more in detail through a description of performed experiments and achieved results. Herein reference will be made to the accompanying drawings, in which.

PERFORMED EXPERIMENTS

A number of 50 kg laboratory heats were manufactured. The chemical compositions in weight-%, and in ppm, respectively, are given in Table 1. The ingots were heated to about 1200° C. and were then forged in the authentic state of the steel without reheating to the shape of bars having the square dimension 60×40 mm. After finished forging, the bars were caused to cool in vermiculite in order to achieve a cooling rate corresponding to the cooling rate that a larger piece of steel will have when it is being cooled from forging temperature to room temperature in air. After cooling to room temperature the samples had a homogenous microstructure substantially consisting of so called low carbon lath martensite, which is a structure which is comparatively easy to work by means of cutting tools.

TABLE 1

Chemical composition of tested steel alloys. Balance iron and impurities

| Steel No. | Heat No. | C % | Si % | Mn % | S % | P % | Cr % | Ni % | Mo % | Al %* | N %* | O ppm* |
|---|---|---|---|---|---|---|---|---|---|---|---|---|
| 1 | Q 8895 | 0.045 | 0.20 | 2.58 | 0.006 | 0.003 | 3.01 | 2.17 | 0.30 | | | |
| 2 | Q 8896 | 0.052 | 0.23 | 2.66 | 0.006 | 0.003 | 3.00 | 3.15 | 0.31 | | | |
| 3 | Q 8897 | 0.057 | 0.18 | 1.80 | 0.006 | 0.003 | 3.10 | 2.14 | 0.31 | | | |
| 4 | Q 8898 | 0.052 | 0.19 | 1.82 | 0.006 | 0.003 | 3.15 | 3.15 | 0.30 | | | |
| 5 | Q 8899 | 0.074 | 0.27 | 1.91 | 0.006 | 0.003 | 3.03 | 3.20 | 0.31 | | | |
| 6 | Q 8900 | 0.033 | 0.22 | 1.85 | 0.006 | 0.003 | 3.07 | 3.18 | 0.30 | | | |
| 7 | Q 8908 | 0.051 | 0.22 | 1.82 | 0.005 | 0.019 | 2.90 | 2.12 | 0.33 | | | |
| 8 | Q 8909 | 0.049 | 0.17 | 1.83 | 0.006 | 0.011 | 3.02 | 2.12 | 0.34 | 0.015 | 0.015 | 95 |
| 9 | Q 8910 | 0.050 | 0.14 | 1.80 | 0.006 | 0.011 | 3.03 | 0.02 | 0.34 | 0.015 | 0.015 | 115 |
| 10 | Q 8911 | 0.053 | 0.11 | 2.48 | 0.006 | 0.011 | 2.87 | 0.03 | 0.32 | 0.015 | 0.015 | 91 |
| 11 | Q 8921 | 0.094 | 0.21 | 1.85 | 0.010 | 0.012 | 2.81 | 2.00 | 0.29 | | | |
| 12 | Q 8927 | 0.090 | 0.27 | 1.93 | 0.005 | 0.011 | 3.23 | 2.12 | 0.33 | | | |
| 13 | Q 8935 | 0.085 | 0.20 | 1.94 | 0.016 | 0.006 | 3.23 | 2.04 | 0.33 | | | |

*Al, N and O were analyzed for steel Nos. 8, 9 och 10

The test materials were examined with reference to hardness, high temper strength, tempering resistance, wear resistance, and impact strength in longitudinal direction according to the Charpy V method. Steel Nos. 11, 12, and 13 satisfied the pre-set requirement as far as the achievement of a hardness in the range 350–380 HB is concerned, without any other heat treatment than cooling to room temperature. The impact strength of all the samples were good.

Figure 1:
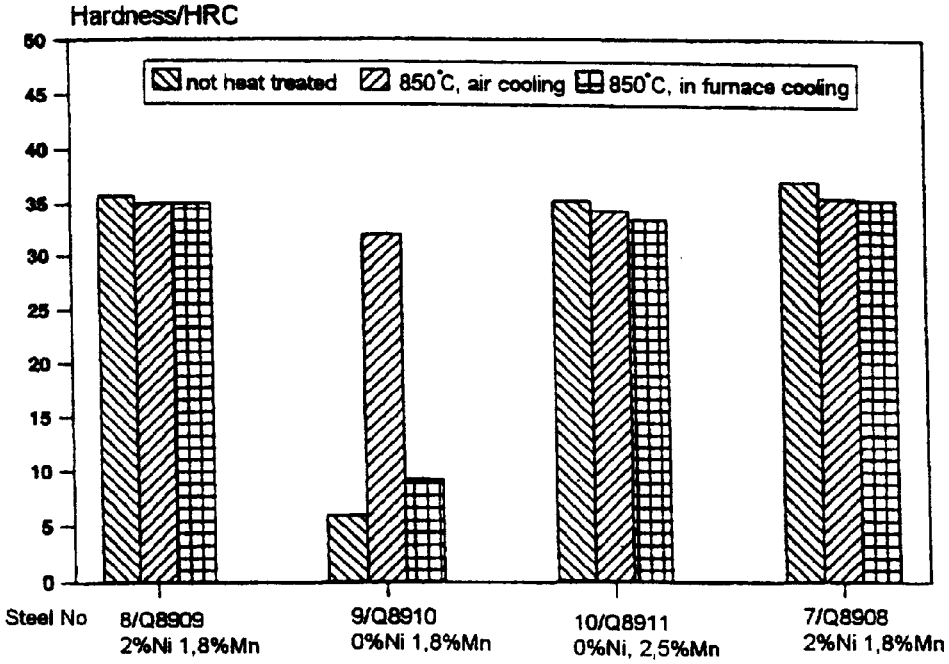
FIG. 1 shows the hardness of rods made of some representative, tested alloys, and subjected to different heat treatments.
Figure 2:
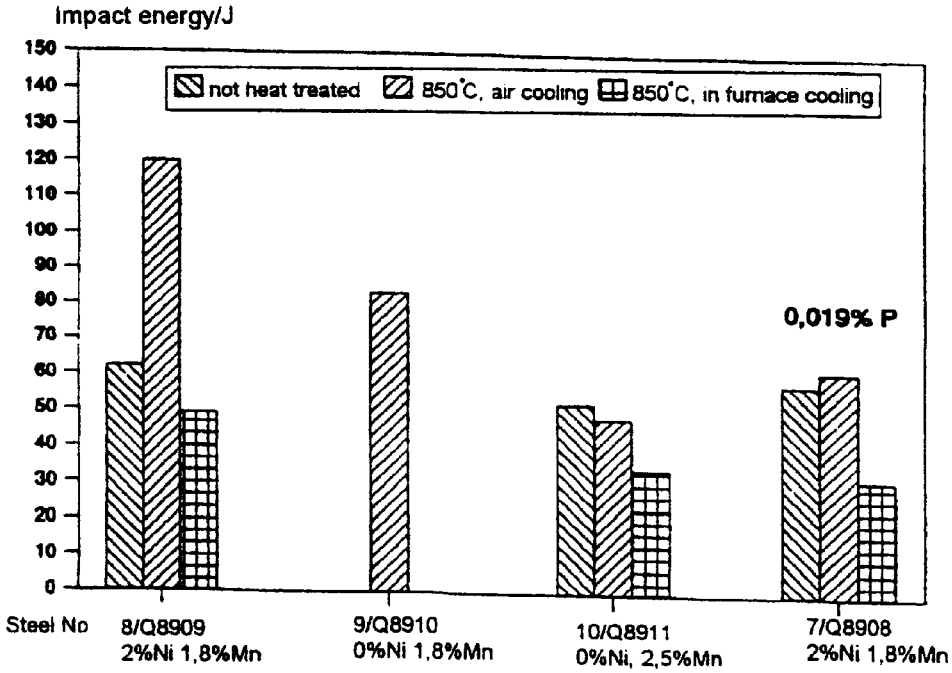
FIG. 2 shows the impact strength of the same materials as according to FIG. 1.
Figure 3:
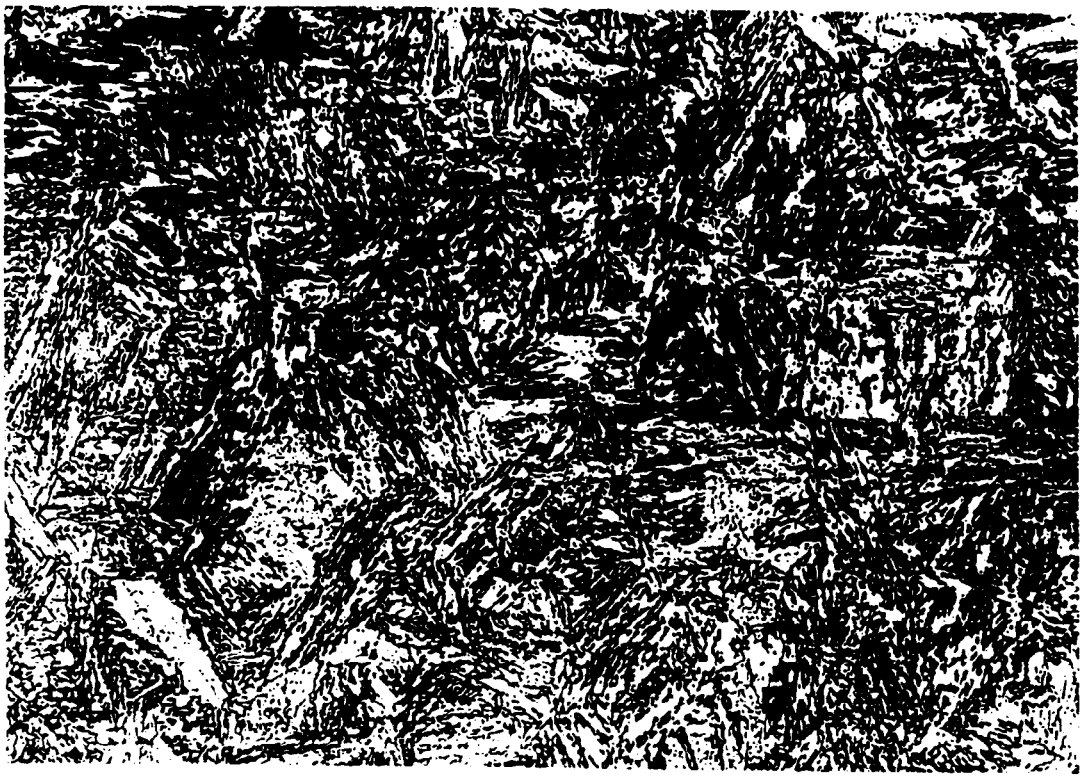
FIG. 3 shows the micro structure of a steel according to the invention.

The results are shown in the diagrams in FIG. 1 and FIG. 2. FIG. 1 shows the hardness of samples taken from rods 60×40 mm cooled in vermiculite. The left hand columns for each steel relate to rods which have not been heat treated, the next columns relate to rods which have been reheated 10 min at 850° C. and then cooled in air, and the right hand columns relate to rods which have been reheated at 850° C. and then caused to cool in a furnace to 200° C. during a period of time of 16 h. FIG. 3 shows the impact strength of samples which have been subjected to the same heat treatment which was referred to in connection with testing with Charpy V length sample. The four steels, for which the results have been reported, were chosen as representatives for steels having varying nickel manganese and phosphorus contents. The reported results are mean values of triple tests.

Then a full size heat, 70 tons, was made of a steel having a composition according to the invention. The heat analyze, i.e. the composition of the molten steel prior to casting was the following (in weight-%), balance iron and other impurities and accessory elements:

| C | Si | Mn | P | S | Cr | Ni | Mo | Ti | Nb | Zr | V | Al | N | Fe |
|---|---|---|---|---|---|---|---|---|---|---|---|---|---|---|
| .087 | .39 | 1.77 | .005 | .007 | 3.22 | 1.98 | .28 | .002 | .002 | .002 | .03 | .025 | .007 | rest |

Of this steel, ingots were made by casting. The ingots were forged and/or rolled to the shape of bars or rods having various dimensions. At the casting operation, a high carbon casting powder was used by mistake, which caused carbonizing of the cast material. Because of the difference in carbon content between the heat analyze and the composition of the cast material the carbon content was analyzed also in the finished rods. Prior to rolling the ingots were preheated at 1120° C. After the final pass the temperature was about 890° C. for all dimensions. Also those ingots which were forged were preheated at 1120° C. No ingots were reheated. After rolling, and after forging, respectively, the bars or rods were allowed to cool freely in air on a cooling bed to room temperature. Micro samples were taken from the rods, and the hardnesses were measured, representing the hardness in the centre of the rods. The following values were obtained, Table 2.

TABLE 2

| Bar dimension | Carbon content | Hardness |
|---|---|---|
| Ø 28 mm | 0.11 % | 380 HB |
| Ø 180 mm | 0.09 % | 365 HB |
| Ø 280 mm | 0.12 % | 367 HB |
| Ø 300 mm | 0.11 % | 262 HB |
| 200 × 40 mm | 0.11 % | 372 HB |
| 746 × 96 mm | 0.10 % | 366 HB |
| 396 × 136 mm | 0.10 % | 363 HB |
| 796 × 196 mm | 0.10 % | 362 HB |
| 396 × 246 mm | 0.14 % | 383 HB |
| 796 × 246 mm | 0.13 % | 363 HB |
| 596 × 293 mm | 0.11 % | 367 HB |
| 596 × 346 mm | 0.13 % | 370 HB |

Also the metallographic structure of the micro samples taken from the centre of all the dimensions were studied. In all cases the structure consisted of lath martensite. An example is shown in FIG. 3.

Figure 4:
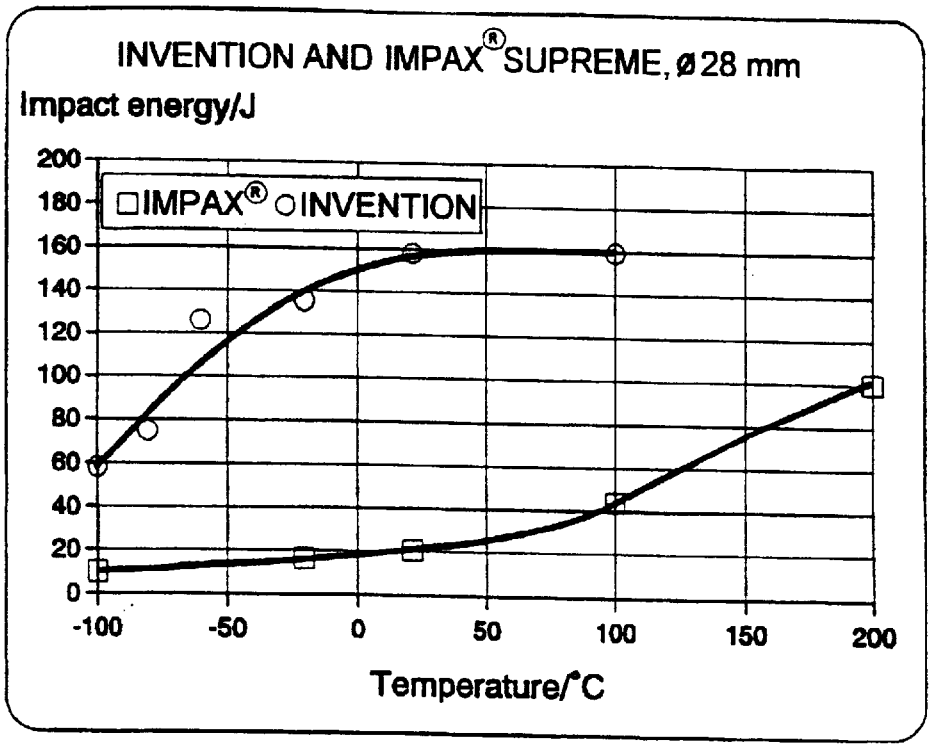
FIG. 4 shows the impact strength of comparatively thin rods made on one hand of a steel of the invention, and on the other hand of a reference steel.
Figure 5:
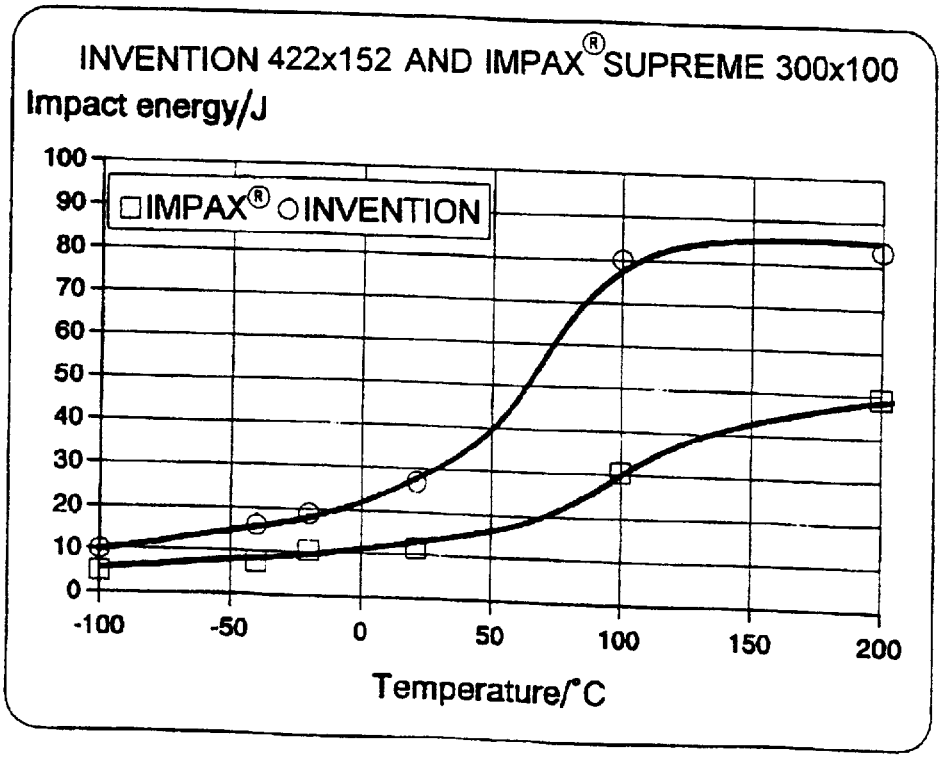
FIG. 5 shows the impact strength of materials having larger dimensions made on one hand of a steel of the invention, and on the other hand of the reference steel.

The impact strength in the delivery condition of the steel were tested according to the Charpy V method, wherein samples were taken from the centre of the rod in the longitudinal as well as in the transverse direction. FIGS. 4 and 5 illustrates the toughness of some bars according to the invention and having different dimension, and as a comparison also a impact strength diagram for the commercial steel grade iMPAX® SUPREME has been included. The composition of the reference material is given in the preamble of this description. From FIGS. 4 and 5 is apparent that the toughness of the material according to the invention is essentially better than that of IMPAX® SUPREME in thin as well as in large cross section dimensions.

Also the surface hardenability by various surface nitriding techniques were tested, namely the following:

Gas nitriding—510° C., 10 h, 30 h, and 60 h

Plasma nitriding—(25% $N_2$,75% $H_2$) 480° C., 10 h, 30 h, and 60 h

Nitrocarburizing in gas—(52% $N_2$, 43% $NH_3$, 5% $CO_2$) 580° C., 150 min

Nitrocarburizing in salt bath (Tenifer)—580° C., 60 min

The following results were achieved.

| Nitriding technique | | IMPAX ® SUPREME | INVENTION |
|---|---|---|---|
| | | Nitriding depth: | |
| Plasma nitriding, | 10 h | 0.15 mm | 0.13 mm |
| | 30 h | 0.26 mm | 0.25 mm |
| | 60 h | 0.37 mm | 0.33 mm |
| Gas nitriding, | 10 h | 0.18 mm | 0.16 mm |
| | 30 h | 0.31 mm | 0.28 mm |
| | 60 h | 0.41 mm | 0.39 mm |
| Nitrocarburizing in gas | | 0.25 mm | 0.20 mm |
| Nitrocarburizing in salt bath | | 0.13 mm | 0.11 mm |
| | | Hardness approx 30 μm below surface | |
| Plasma nitriding | | 750 MHV | 950 MHV |
| Gas nitriding | | 750 MHV | 950 MHV |
| Nitrocarburizing in gas | | 600 MHV | 800 MHV |
| Nitrocarburizing in salt bath | | 650 MHV | 900 MHV |

What is claimed is:

1. Steel alloy, characterized in that it has the following composition in weight-%:

0.075–0.15 C from traces to max. 1.0 Si

1–3 Mn

2–5 Cr

1–4 Ni wherein the total amount of Mn+Cr+Ni≧6

0.1–1.0 Mo, which wholly or partly can be replaced by the double amount of W max. 0.012 P max. 0.02 S, wherein strong carbide formers belonging to the group of elements consisting of V, Nb, Ta, Ti, and Zr do not exist in the steel in amounts exceeding impurity levels, balance essentially only iron and impurities and accessory elements in normal amounts.

2. Steel alloy according to claim 1, characterized in that it contains at least 0.08 C.

3. Steel alloy according to claim 1, characterized in that it contains max. 0.12 C.

4. Steel alloy according to claim l, characterized in that it contains 1.5–4 Cr.

5. Steel alloy according to claim 1, characterized in that it contains 1.5–3 Ni.

6. Steel alloy according to claim 1, characterized in that it contains 0.2–0.5 Mo.

7. Steel alloy according to claim 1, characterized in that it contains max refer 0.010 P.

8. Steel alloy according to claim 1, characterized in that it contains 0.005–0.01 S.

9. Steel product in the form of a block, a bar, rod or plate consisting of a steel alloy having a chemical composition according to claim 1, characterized in that the product has been afforded the shape of said block, bar, or plate by casting and plastic heat treatment in the austenitic state of the steel, whereafter the steel has been caused to cool to room temperature but subsequently not been object to any heat treatment in the form of through hardening and/or tempering, and that the product has a homogenous micro structure which to at least 95 vol.-% consists of lath martensite.

10. Steel product according to claim 9, characterized in that the structure substantially consists of lath martensite.

11. Steel alloy according to claim 2, characterized in that it contains at least 0.09 C.

12. A method of manufacturing plastic molding tools comprising using the steel alloy of claim 1 after cooling after finished hot working through forging, rolling, or forging and rolling to the shape of blocks, rods, or plates.

13. A method of manufacturing plastic molding tools comprising using the steel alloy of claim 9 after cooling after finished hot working through forging, rolling, or forging and rolling to the shape of blocks, rods, or plates.

14. Steel product according to claim 10, characterized in that the lath martensite has a Brinell hardness (HB) of at least 350.

15. Steel product according to claim 14, characterized in that the Brinell hardness is 350–380 HB.

* * * * *